United States Patent [19]

Streicher

[11] 4,211,521

[45] Jul. 8, 1980

[54] ECCENTRIC DISC PUMP

[75] Inventor: Max Streicher, Wangen im Allgäu, Fed. Rep. of Germany

[73] Assignee: Fördertechnik Streicher GmbH, Wangen im Allgäu, Fed. Rep. of Germany

[21] Appl. No.: 886,356

[22] Filed: Mar. 14, 1978

[30] Foreign Application Priority Data

Mar. 19, 1977 [DE] Fed. Rep. of Germany ..... 2712121

[51] Int. Cl.[2] ..... F04C 1/06; F04C 29/04

[52] U.S. Cl. ..... 418/48; 418/83; 418/91; 418/149

[58] Field of Search ..... 418/48, 83, 91, 149

[56] References Cited

U.S. PATENT DOCUMENTS

| | | | |
|---|---|---|---|
| 2,902,935 | 9/1959 | Dinnison et al. | 418/149 |
| 3,512,904 | 5/1970 | Allen | 418/48 |
| 3,912,426 | 10/1975 | Tschirky | 418/48 |
| 3,975,121 | 8/1976 | Tschirky | 418/48 |

FOREIGN PATENT DOCUMENTS

| | | | |
|---|---|---|---|
| 1238237 | 7/1971 | United Kingdom | 418/48 |

*Primary Examiner*—Leonard E. Smith

*Attorney, Agent, or Firm*—Montague & Ross

[57] ABSTRACT

The eccentric disc pump has a series of stator discs defining a series of axially interconnected pump stages each having a rotor disc mounted eccentrically on a common shaft extending within central cavities of the stator discs and angularly offset relative to the rotor disc of a preceding pump stage, adjacent stator and rotor discs being angularly offset one relative to the other at given angles of displacement and coupling means, e.g. rods, wedges and grooves or studs and recesses, respectively engaging each stator disc with that of an adjacent pump stage and positively locating such adjacent stator discs in positions, offset by a second angle one half of the first mentioned angular displacement between corresponding adjacent rotor discs whereby in each pump stage the cavity of the stator disc forms an enveloping curve for the path of the rotor disc rotatable therein.

21 Claims, 21 Drawing Figures

15
24
30
31
28
29
26a
26b
26c
25
32
s
t
33
34
35
36
37
40
41
41a
38
39
42
43
44
45
a
f

ECCENTRIC DISC PUMP

FIELD OF THE INVENTION

The present invention relates to an eccentric disc pump which has individual but axially interconnected pump stages comprising in each case a stator disc enclosing a central cavity and a rotor disc eccentrically rotating in this cavity. Adjacent stator and rotor discs are each angularly offset from each other by given angles and the rotor discs are held in rotary engagement on an eccentric shaft in such manner that in each pump stage the cavity of the stator disc forms an enclosing curve for the track or orbit of the rotor disc rotating therein.

BACKGROUND OF THE INVENTION

An eccentric disc pump of this type is described in German Published Application No. 25 30 552. The rotary discs, on the circumference of which rolling rings are mounted, are initially slipped onto the eccentric shaft and axially clamped. The individual stator discs are drawn in succession onto the shaft, and are then arranged by turning the rotor and clamped by tiebolts between the end portions of the stator. Since the adjustment of the stator discs is effected from the rotor discs by means of the sliprings, the alignment of the discs is comparatively inaccurate. In addition, they are held together merely by friction forces and secured relatively to parts of the housing of the pump.

This arrangement has proved to be sufficient for some purposes, but is not satisfactory when working with comparatively high pressures and fast speeds of rotation. This applies in particular to cases in which stable rolling rings of hard material are being used as is sometimes necessary, for example, when using the pump in chemical applications.

OBJECT OF THE INVENTION

The object of the present invention is to provide an eccentric disc pump of the above-mentioned type in the most simple manner possible, so that, independently of the materials employed for the parts of the pump, the quietest operation possible of the pump is obtained, with a reliable seal between rotor and stator and, consequently, high working pressures with a high pump delivery can be obtained.

SUMMARY OF THE INVENTION

In order to achieve this object, the stator discs of adjacent pump stages are exactly positioned according to the invention relatively to each other by coupling means engaging positively the pump stages at a second partial angle which has half the value of the first partial angle formed between the rotor discs of the same pump stages.

In this embodiment of the pump, the inaccuracies are avoided which may occur upon positioning of the stator discs by means of the rotor. The stator discs are positively secured to each other, on the other hand, according to the mathematically determined path of rotation of the interconnected rotor discs, so that the rotor can roll over a clearly defined track in the stator. Although the continuous eccentric disc pump is divided in this case into individual pump stages joined together, the rotor can be very accurately guided in the stator in this manner so that the contact forces between rotor and stator remain substantially constant.

This constancy of the contact forces has the desired improvement in sealing as a result, thus rendering greater pressures possible. The uniform controlled rotation of the rotor reduces any mass forces, so that greater speeds of rotation and, consequently a greater pump delivery can be achieved, with reduced vibration. Damping means such as elastically deformable rolling rings may be of advantage in this case, depending on the proposed object. However, if it is a question of the suppy of a mainly fluid material to entraining only small amounts of solids, rolling rings of very hard and stable materials may be used. Under these conditions the use of rolling rings may be completely abandoned, since, due to the accuracy of the controlled rolling the wear on the rolling surfaces is considerably reduced. It has in fact become apparent that, with the use of wear-resistant materials for stator and rotor discs, the wear is so slight that the achievable pressure is not substantially reduced even after a comparatively long period of operation and there are no appreciable changes between rest and the maximum speed of rotation. In addition, stator and rotor discs themselves can be readily replaced at any time.

At least two coupling means arranged symmetrically to the axis of the pump may be provided and mounted preferably at the side of the oblong cavity of the stator plates. Thus the stator plates may each have, near their circumference, at least one recess which is open in the direction of the pump axis on one side and in which a raised coupling member of the adjacent stator disc engages, said member being turned through the second partial angle relatively to the associated recess. The recess and a coupling projection engaging therein may be fully formed on the stator discs. No additional connecting rings are then necessary, it is only necessary to turn the stator discs until the successive recesses and the associated coupling projections interengage.

For some purposes it may be desirable to provide the stator discs with axial apertures relatively offset by the second partial angle, one coupling pin engaging in two registering apertures of adjacent stator discs. This embodiment has the advantage of special accuracy in alignment with the coupling pin then acting as a shear pin or overload safety device. It is obvious that any other known overload safety devices may be used.

If this coupling pin is formed by a turnbuckle, it may be used for the tensioning of adjacent stator discs, i.e. the entire disc assembly is screwed together from stage to stage. It can be advantageous to form a depression extending from the circumference of the stator discs, the depression forming two lateral wall members. The apertures can extend through both wall members and the length of the coupling pin is then at most equal to the width of a stator disc. The connection may then be released by the coupling pin being completely inserted into one of the two discs. The pin can even be removed through the depression if its length at the most is equal to the width of the depression. This embodiment is particularly important for the divison of the stator discs to which reference is to be made hereinafter.

While hitherto only axially operating coupling means have been mentioned, such means may also have a coupling member engaging radially in the circumference of the stator discs, particularly when the stator discs have at least two coupling recesses relatively offset by the same partial angle and into which a coupling member extending across two pump stages engages radially from outside. The coupling may usually disengage without engaging further into the disc assembly, for example, when the coupling recesses are formed as longitudinal grooves in which a longitudinal wedge engages.

According to one embodiment, coupling means may be provided for a plurality of different second partial angles. For example at least three coupling means may be relatively angularly offset by a partial unit angle for each coupling position, said unit angle being determined by the smallest partial angle concerned. In this way it is possible to assemble pumps with different screw pitches or different partial angles from the same disc member. If, for example one starts with a first partial angle of the rotor discs of 30°, the second partial angle for the stator discs amounts to 15°. With a partial angle unit of for example 7.5°, partial angles of 7.5°, 15°, 22.5°, 30° and so on may be established.

In this case it may be advisable to arranged coupling means relatively displaced by the partial angle unit over the entire circumference of the stator plates. For example, the outer peripheral surface of the stator discs may be provided with relatively displaced alternating longitudinal grooves and wedge projections by the second partial angle, but particularly by the partial angle unit, between which longitudinal grooves and projections at least one common longitudinal wedge extending over the entire length of the stator engages. A plurality of longitudinal wedges may be connected to at least one annular connector extending over a partial length of the stator or formed as the stator sleeve completely enclosing the stator discs.

According to another proposal, the longitudinal wedge is formed as a wedge projection of an inflexible, substantially rigid adjusting rail which can be secured to parts of the housing carrying the stator and used as a tiebar between two stator end plates.

According to a further embodiment, the stator discs may have a ring of axial apertures which receive at least one coupling rod extending over the entire stator length. A plurality of such coupling rods may be used in turn as tiebars and screwed to the end plates of the stator, or tensioned in any other manner.

It is even simpler to form on one side of each stator disc a ring of recesses and, on the other side, a ring of coupling projections engaging therein.

A further effect is obtained, for example, if an inner serration is formed on one side of the stator discs and an outer serration fitting therein is formed on the other side.

In the exact guidance now achieved between stator and rotor discs, at least the stator discs, and, if desired, the rotor discs may be made of refractory ceramic material, more particularly, oxide ceramic. Such ceramic materials withstand operating temperatures far above 1,000°, without experiencing any substantial changes of shape. Above all, in the case of discs of such materials or fully finished discs, it is important that they should be subjected to subsequent processing of the plain surfaces in order to be exactly and closely in contact with each other.

In order to obtain an optimal seal of the plate assembly at least one sealing ring may be inserted between stator discs and may have for example an O-ring disposed in an annular groove of each stator disc.

In addition, for various uses, it may be advisable to form openings at least in the stator discs for the passage of a heat-exchange medium, these openings extending over an angle which is greater than the partial angle. The ends of the passage may be provided with sealing rings.

At least the cavity of the stator discs, if desired also of the rotor discs, may be lined with a shape-stable moldable material, for example epoxy resin or mouldable ceramic compositions. This again is very important in the production of finished moulded parts which have a comparatively rough and possibly uneven inner surface. A very exact, curved shape may be obtained by the lining.

The pump unit may be simplified and rendered inexpensive if two stator and/or rotor discs of adjacent pump stages are molded together in one piece to form a double disc. In the case of a stator double disc, two cavities offset from one another by the second partial angle may be formed, for example, from both front ends independently of whether the surfaces of the cavity already have the final shape or whether they are finished subsequently with lining material. In this manner half the number of disc members are sufficient and the partial angle is immediately determined in the disc member. The possible subsequent processing is also simplified. It may be of special importance in some cases to divide the stator discs transversely along the axis of the pump and to detachable connect both disc parts together. In order to replace individual stator discs, it is then not necessary to dismantle the entire stack of discs, but, after releasing the coupling and connecting means, both halves of the disc may be released radially from the stack of discs, but on opposite sides and exchanged for other disc elements.

SPECIFIC DESCRIPTION

Figure 1:
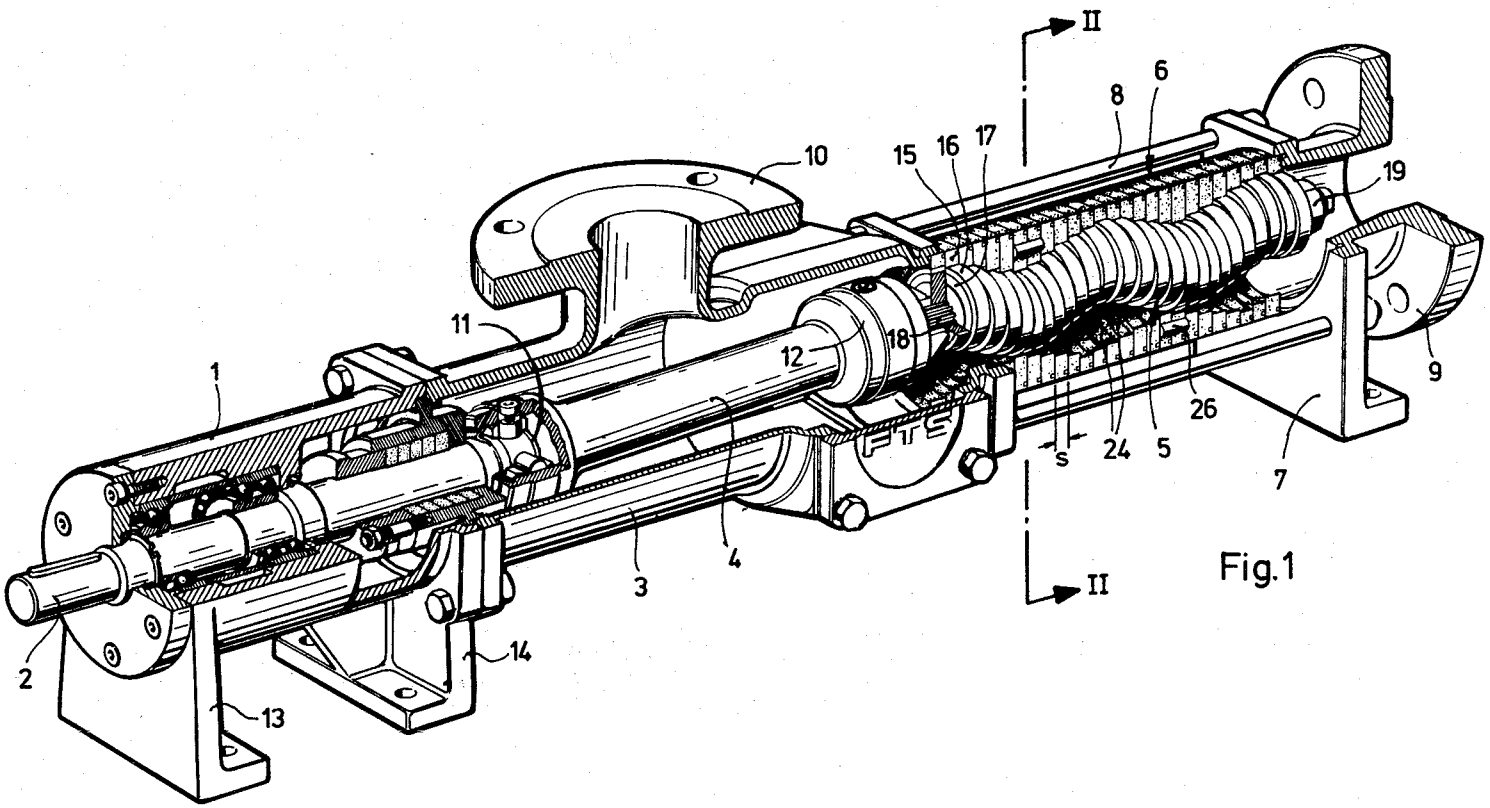
FIG. 1 is a perspective view of an eccentric disc pump according to the present invention, partly in section.
Figure 3:
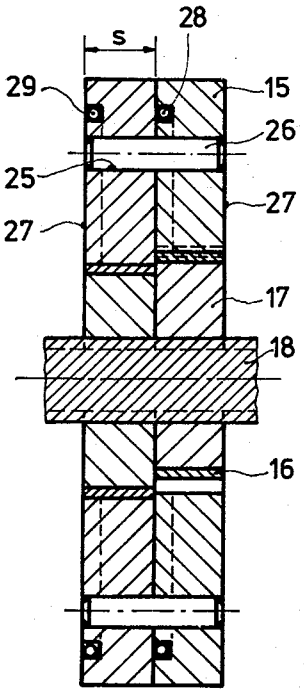
FIG. 3 is a section taken on the line III—III of FIG. 2, FIGS. 4–11 are partial sections, corresponding to FIG. 3 taken through modified embodiments of the stator.
Figure 2A:
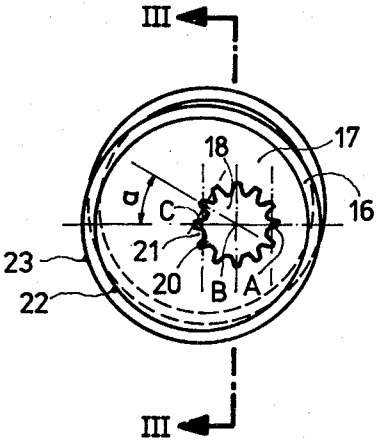
FIG. 2*a* is the associated section through the rotor.
Figure 2:
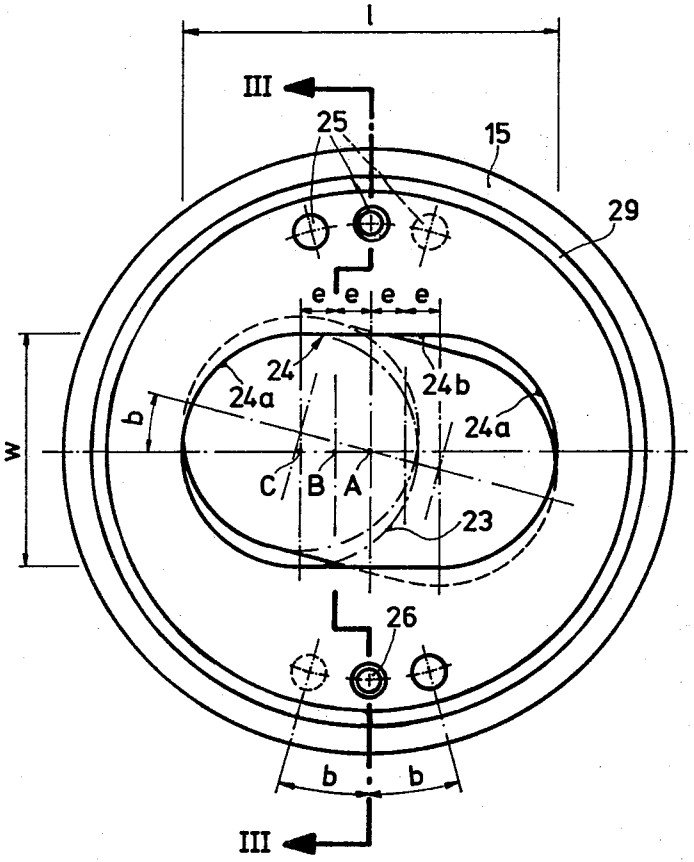
FIG. 2 is a cross-section through the stator taken on the line II—II of FIG. 1, showing two stator discs.

The eccentric disc pump shown in FIGS. 1 to 3 substantially comprising a bearing housing 1 for a drive shaft 2, a cardan shaft housing 3 for a cardan shaft 4, the rotor 5 and the stator 6 which is tensioned between the cardan shaft housing 3 and an end plate 7 by tiebars 8. Connecting sockets 9, 10 are mounted on the end plate 7 and the cardan shaft housing 3 respectively and form an inlet or outlet of the pump according to the direction of rotation of the drive shaft 2 or the rotor 5 respectively.

The cardan shaft 4 is connected to the driving shaft 2, on the one hand, and the rotor 5, on the other hand, by universally adjustable pivot heads 11, 12. The bearing housing 1, which receives the bearing and seal for the driving shaft 2, rests on footplates 13 and 14 which, with the end plate 7, carry the entire pump. The housing arrangement shown in FIG. 1 and the drive of the rotor are well known and will therefore not be described in detail.

The pump, formed by the rotor and stator, is a further development of the well known helical screw pump which, however, is divided into individual pump stages instead of having continuously curved surfaces each of which has a stator ring 15 and a rotor disc 17 of the same width with an inserted bearing ring 16. The width s of the individual pump stages may be varied as required over the length of the pump, but is preferably kept constant for reasons of production.

An eccentric shaft 18 carries the rotor discs 17. The rotor discs are tensioned thereon close to the pivot head 12 against a contact surface (now shown) by a nut 19 provided on the free end of the eccentric shaft. As may be seen most clearly from FIG. 2*a*, the shaft is formed as a multi-key shaft with longitudinal key wedge ribs 20 and interposed grooves 21. The first partial angle a formed between the key wedge ribs and longitudinal ribs is 30°. Adjacent rotor discs 17 are each displaced by one key wedge rib and thus slipped, rotated through a first partial angle a, onto the eccentric shaft 18. The shaft axis B of the eccentric shaft 18 rotates about the pump axis A with the eccentricity e, and the axis C of the cylindrical outer surface 22 of the rotor disc rotates with the same eccentricity e about the shaft axis B, likewise the outer surface 23 of the cylindrical bearing ring 16. The individual rotor discs 17 and roller rings 16 therefore each execute double eccentric rolling processes.

The bearing rings 16 rotate, during the operation of the pump, on the outer cylindrical surfaces 22 of the rotor discs and roller in elongated cavities 24 which are formed at the center of the cylindrical stator rings 15. This cavity has two semi-cylindrical end portions 24*a* with the curvature of the outer surface 23 of the rolling rings and two plane connecting sections 24*b* with a length 4*e*. The width w thereof corresponds to the diameter of the outer surface 23, the length 1 thereof is w and 4*e*. The dimenions of the cavity 24 correspond to the section which would be obtained in a continuously curved eccentric worm pump in the plane extending through the middle of the pump stage. Whilst a surface continuously curved in all directions is used in one case, surfaces are used here all of which extend parallel to the axis of the pump. The rolling operation remains practically unchanged thereby for the axis B of the eccentric shaft. The contact reaction forces all act, however, transversely to the axis B of the shaft and, consequently, also transversely to the axis A of the pump.

In the end position shown in FIG. 2 the peripheral surface 23 of the rolling ring in contact with the left-hand end surface 24*a* of the cavity leaves an crescent-shaped space free which is limited by two semi-arcs and the surfaces 24*b*. During further rotation of the rotor, the peripheral surface 23 moves to the opposite end portion 24*a*, whilst the right-hand crescent-shaped space is reduced, whilst again an increasing crescent-shaped space is formed on the left. These two crescent shaped spaces are sealed on the one hand relatively to each other by the rolling ring 16 and are also in contact in each case with at least one crescent-shaped space of an adjacent pump stage. When the crescent-shaped space increases in size, they extract from the adjacent space and when it is reduced, they feed into this space. Each individual pump stage thus forms a double acting pump unit, both front spaces of which compensate each other to a considerable extent, so that a practically constant supply stream is obtained.

The cavities 24 form a stag-like double spiral, the peripheral surfaces 23 form a similarly stage-like single spiral. When the rotor 5 rotates once, the pheripheral surface 23 moves from one end portion 24*a* to the other. At the same time, however, the cavity 24 must have reached the same position again as in FIG. 2, i.e. on the length of pump in which the rotor discs are turned relatively to each other by a total of 360°, the stator discs must be turned relatively to each other only through 180°. The second partial angle b between adjacent stator discs is therefore only half the value of the first partial angle a which is formed between adjacent rotor discs 17. Therefore exact rolling guidance for the rotor is obtained when, with pump stages remaining equal to each other, the other stator discs 15 to be kept central relative to each other from stage to stage, are secured to each other with the angle b.

For this purpose two diametrically opposed pairs of apertures 25 formed as bores, are made in the stator discs laterally of the longitudinally surfaces of the cavity 24 exactly at the angle $b=a/2$. Two of such apertures 25 then coincide between adjacent stator discs and receive a coupling pin 26 which acts as a shear pin and consequently as an overload safety device. This function may be obtained if desired also by any other known means.

The use of two coupling pins 26 also makes it possible, in addition to the angle adjustment, to centre the pump axis A. If any other centring is present, it is possible to operate, if desired, with a single coupling pin.

The front surfaces 27 of the two stator discs are ground completely plane over the entire measurement of the stage width s. Formed close to the cuter edge, in one of these front surfaces, is an annular groove 28 receiving a ring gasket 29 formed in this case by an O-ring. A seal is therefore obtained both on the ground front surfaces and also on the sealing ring or gasket which, in the tensioned condition, i.e., after the tightening of the tiebars 8, does not project beyond the front surfaces 27.

Figures 4, 5, 6, 7, 8, 9, 10, 11, 12, 13, 14:
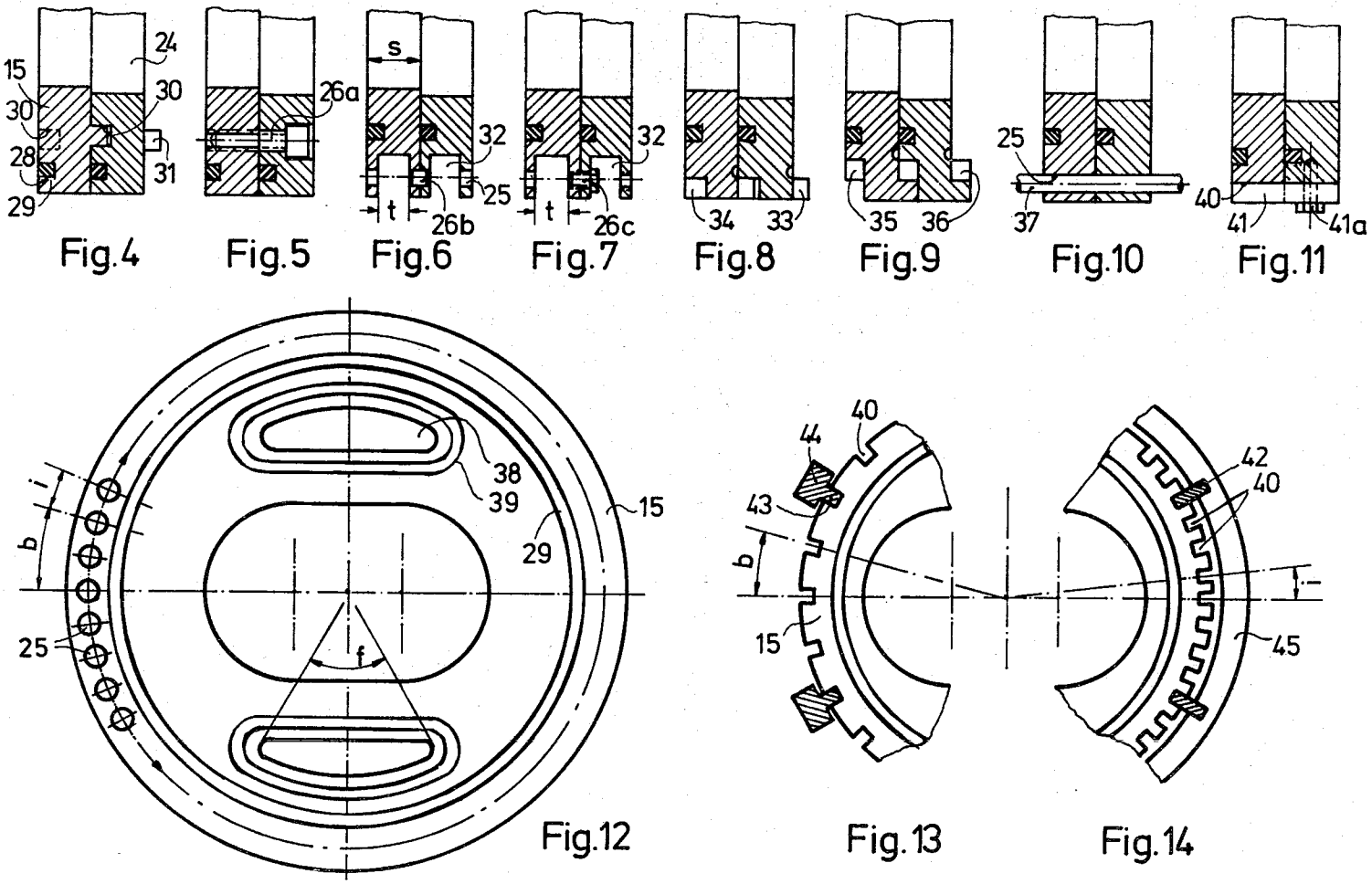
FIG. 12 is a view of a stator disc with the embodiment of a coupling according to FIG. 10, FIGS. 13 and 14 are partial views of a stator disc with continuous longitudinal wedges as coupling means.

According to FIG. 4 there are formed on one front surface two diametrically opposed pocket-like recesses 30 and, on the opposite side, displaced through the second partial angle b relatively to this recess, beak-like coupling projections 31 which come into fitting engagement with each other when adjacent stator discs are turned. The stator discs are indicated from now on by 15, independently of the changing design.

The illustration in FIG. 5 differs from FIG. 3 merely by the feature that the coupling pins 26 are formed by internal edge head screws. Tensioning may be effected from stage to stage so that the number of tiebars 8 can be limited if desired.

According to FIG. 6, the apertures 25 may be formed close to the outer edge of the stator disc and a depression 32 is made on the outside at least in the region of the apertures, the width t of said aperture corresponding to at least half the stage width s. The coupling pins 26*b* provided there have a length corresponding in turn to approximately the width of t. They may therefore be introduced through the depression 32 and be removed therefrom again. This is very important for the embodiment shown in FIG. 19.

The coupling pin 26*c* according to FIG. 7 is formed as an external edge head screw and also kept so short that it can be introduced through the depression 32. In turn, it makes the tensioning of stages possible as does the coupling pin 26*a* in FIG. 5.

According to FIG. 8 a front serration 33, projecting all round, is formed directly on the cuter edge of the stator discs on one front side and on the other front side a front serration 34 fitting therein. Due to the engagement of these teeth a centring effect can then be obtained. The individual teeth can be relatively displaced there with a clearance equal to the second partial angle b (FIG. 2) but also by a partial unit angle (FIGS. 12, 14) which divides several times into the second partial angle b. This partial angle unit i may amount for example to 7.5°, but also approximately 5°. In this manner a partial angle may be changed as desired through 7.5°. However, attention must be paid to ensure, if uniform rolling of the rotor in the stator is to be guaranteed, that also the ratio of both partial angles a/b must be constant in each indiviual stage.

On the other hand, it is possible however to combine pump stages of different width in one pump by inserting a 50, 100 or 150% larger stage width s at the ends of the pump.

The front serration of FIG. 8 may also be shifted further inwardly in a radial direction, only it is more difficult in that case to grind close to the serration.

According to FIG. 9 an outer serration 35 is formed on the front the outer circumference of the stator discs with a clearance there from and on the other front thereof an inner serration 36 which radially interengage but can be axially pushed into each other and in turn act as centering means. Here again a fine serration may be used as described above.

The coupling rods 37 according to FIG. 10 are drawn in through the entire length of the pump. This makes it necessary for the apertures 25 to be provided, with a uniform angular clearance b or i over their entire circumference as shown by the associated FIG. 12. Even if the individual coupling rods 37 have only a limited cross-section they can be drawn in a comparatively large number and thus take over the function of the tiebars 8. According to FIG. 12, elongated apertures 38 are formed within the gasket 29 laterally of elongated cavity 24 and are surrounded at one end by separate gaskets 39 so that a heat-exchange medium can be conveyed through for heating and cooling the stator. The apertures 38 extend over a circumferential angle f which is appreciably greater than the greatest second partial angle b concerned, so that the heat-exchange medium can flow always from one pump stage to the other in a spiral track.

By connecting members mounted on the ends of the stator, the heat-exchange medium can be controlled so that it flows either through both channels in parallel or in counterflow.

According to FIG. 11, preferably rectangular longitudinal grooves 40 are formed in the circumference of the stator discs, in which grooves wedges 41, extending over two pump stages are inserted. These wedges can be secured at least by one screw inserted radially from outside on at least one stator disc. A similar effect is achieved in this manner as in the case of the depressions 32 for use as in the embodiment in FIG. 19.

According to FIG. 13, longitudinal grooves 40 are provided over the entire circumference of the disc at the second partial angle b. In this manner a multi-wedge profile is formed over the entire outer surface of the stator, similarly to the eccentric shaft with continuous longitudinal grooves into which longitudinal wedges 42 (FIG. 14) or a wedge-like projection 43 can engage associated with rigid guide rails 44 (FIG. 13). These rigid rails may be secured in any sutable manner to the supporting parts of the housing of the pump. They may be secured thereto by threaded pins provided at their ends or individual longitudinal screws, and then serve as tiebars which also centre the individual stator rings. Differing from the illustration in FIG. 13, the grooves 40 may have the shape of an outwardly open angle into which one edge of a guide strip of rectangular cross-section engages. The grooves 40 may also have a curvature adapted to the diameter of cylindrical tiebars 8.

According to FIG. 14, the grooves 40 are formed with the partial angle unit i, and the wedges are externally supported on the longitudinal grooves 40 of at least one centring ring 45. Several such centring rings may be provided over the length of the stator. However, a jacket pipe enclosing the entire stator may be used as centring ring.

Figure 15:
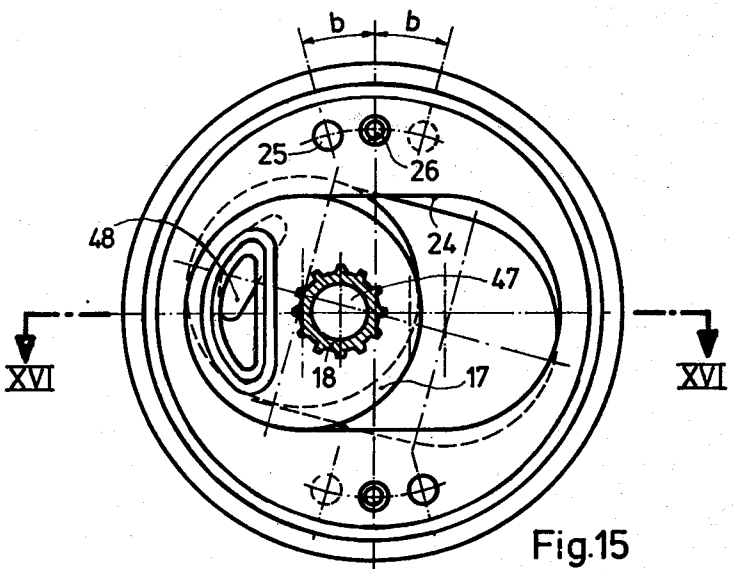
FIG. 15 is a cross-section, corresponding mainly to FIG. 2, through an eccentric disc pump with cooling of the rotor.
Figure 16:
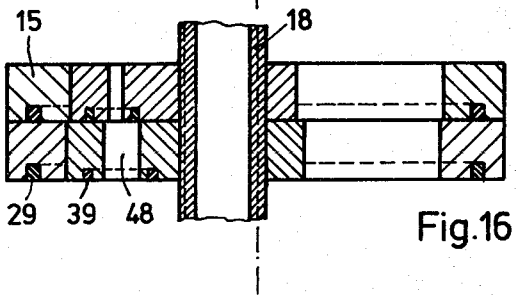
FIG. 16 is a section through this embodiment taken on the line XVI—XVI of FIG. 15.
Figure 20:
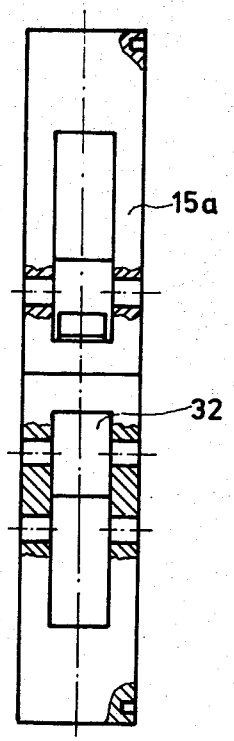
FIG. 20 is a view of this stator disc, seen from the left of FIG. 19.

According to FIGS. 15 and 16, the eccentric shaft is provided for conveying coolant, with a longitudinal bore 47. Formed in the thickened portion of each rotor disc 17 is an aperture 48, the circumferential angle of which is in turn much greater than the first partial angle a so that the individual openings in the adjacent pump stages are in flow communication. At least one couterflow duct is advisable in this case, as only one guide cap needs to be mounted on the free end of the rotor. Separate packing rings 39 may also be provided on the front end s of the apertures.

Depending on the proposed use, a decision must be made as to whether the heat-exchange medium is to be conveyed through the stator or rotor, this being simpler in the first case, since a twin passage duct through the cardan shaft is not required. Basically, however, both heat-exchange ducts may be applied to the same pump.

According to FIGS. 15 and 16 rolling rings are completely avoided. The rotor disc 17 therefore rolls directly in the cavity 24 of the stator disc. This is particularly possible immediately in the case of the exact alignment of the stator discs and the guiding of the rotor discs achieved according to the present invention, if these discs consist of correspondingly were-resistant materials. On the one hand, only very limited sliding processes take place in this case and, on the other hand, somewhat high temperatures or chemically aggressive conveying media may, due to operating conditions, make it necessary to dispense with separate bearing rings. While the material normally used for the stator and rotor discs is steel, the use of sintered materials or ceramic materials may be suitable for special purposes, such as in the chemical industry for pumping corrosive liquids.

In particular, the use of these materials permit mass production of the discs if the usually desirable grinding of the front surfaces is dispensed with. This is particularly important for example for the formation of stator discs according to FIGS. 4, 8 and 9.

Figure 18:
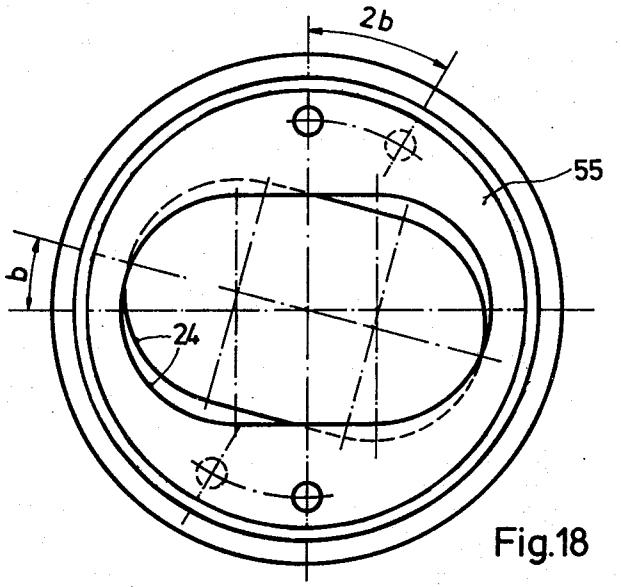
FIG. 18 is a top view of this double disc according to FIG. 17.
Figure 17:
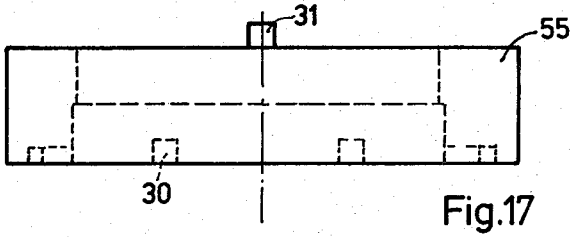
FIG. 17 is a view of a stator double disc.

This mass production however, makes it also possible to produce double discs 55, namely rotor discs and also stator discs according to FIGS. 17 and 18. In the case of a cylindrical outer circumference, it is only necessary to form both the oblong cavities 24 from opposite sides. Since these cavities are to be provided with a second partial angle b, the coupling means must be provided with the angle *2b*, for example, diametrically opposed recesses 30 on one front side and coupling projections 31 on the other front side. Rotor and stator can then be produced with an unchanged number of pump stages from half the number of disc members. Manufacture and storage are further cheapened.

Some methods of manufacture make it possible for the surfaces essential for the function of the pump not to be manufactured with the necessary accuracy or surface quality. These surfaces are then produced with excess or under measurements, and a suitable coating such as epoxy resin or fillers known the lining of ceramic bodies, are formed, in that case, by a known method of application with great accuracy and surface quality.

Figure 19:
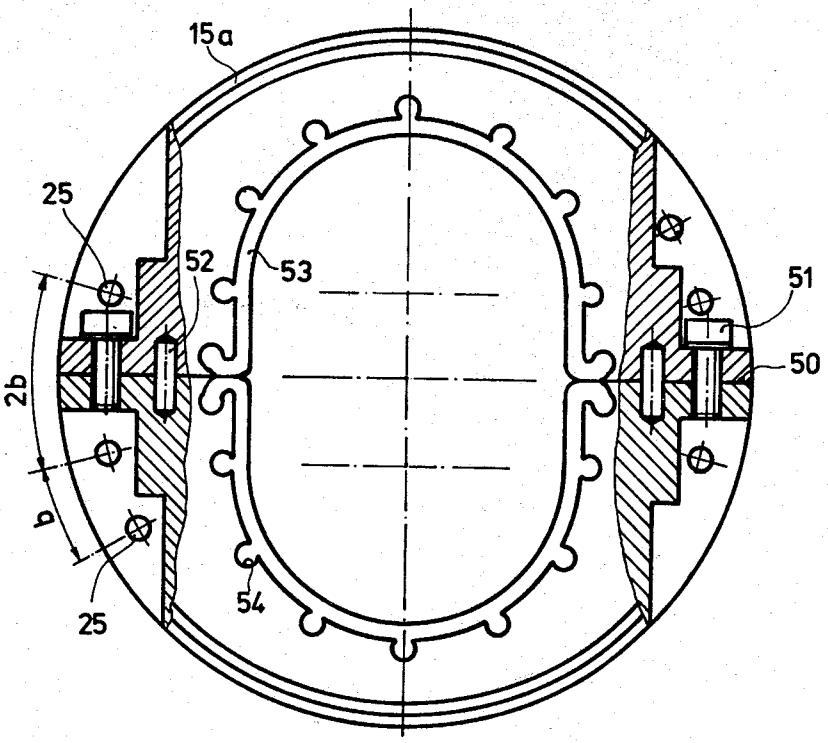
FIG. 19 is a view of a transversely divided stator disc, shown partly in section

In the embodiment shown finally in FIG. 19, the stator disc is formed by two practically identical disc halves 15*a* which, for example, are joined together in a central transverse plate 50 and can be tensioned together there by screws 51. In the plane of separation a seal, a plate or the like, deformable under pressure, may be provided. The recess for the screw 51 is formed by the depression 32 through which three apertures 25 can be formed at the partial angles b and *2b*. Both halves of the disc are exactly aligned with each other by two matching pins 52.

The disc halves formed as castings, ceramic or sintered molded parts, are provided on their inside with a lining 53 which may consist of a material suitable for the particular purpose of use, for example of rubber or very elastic synthetic material. In order to ensure that this lining is reliably secured in the stator disc, anchoring recesses 54, in which the lining material engages, are formed thereon.

Instead of the tensioning means shown, annular sprin tensioning devices may be inserted between adjacent stator discs, i.e., four tensioning rings having four interengaging double bevelled clamping surfaces are tensioned against each other by axial screws so that they exert radial tensioning forces on the stator discs enclosed by them with elastic deformation.

What is claimed is:

1. An eccentric disc pump having a plurality of individual axially interconnected pump stages of predetermined width, a stator disc in each pump stage enclosing a central cavity, a shaft carried in said central cavities, a rotor disc mounted in each pump stage for rotation eccentrically in said central cavity, successive rotor discs being angularly offset relative to the rotor disc of a preceding pump stage and adjacent stator and rotor discs being angularly offset relatively to each other at angles of displacement, coupling means respectively engaging each stator disc with that of an adjacent pump stage and positively locating such adjacent stator disc in positions offset by a second angle one half of the first mentioned angular displacement between corresponding adjacent rotor discs whereby in each pump stage the cavity of the stator disc forms an enveloping curve for the path of the rotor disc rotatable therein, coupling means are provided for a plurality of different second angles of displacement.

2. An eccentric disc pump according to claim 1 wherein at least the cavity of the stator disc is lined with stable shape-retaining moldable material.

3. An eccentric disc pump according to claim 1 wherein two stator or rotor discs of adjacent pump stages are formed together in one piece as a double disc.

4. An eccentric disc pump according to claim 1 wherein a plurality of longitudinal wedges are connected to at least one annular connector.

5. An eccentric disc pump according to claim 4 wherein the outer circumferential surface of the stator discs is fitted with alternating longitudinal grooves relatively offset through one of said angles of displacement and with wedge projections, at least one common longitudinal wedge extending over the entire length of the stator being engaged between them.

6. An eccentric disc pump according to claim 1 wherein at least one packing ring is inserted between adjacent stator discs.

7. An eccentric disc pump according to claim 6 wherein the packing ring has an O-ring located in an annular groove of each stator disc.

8. An eccentric disc pump according to claim 1 wherein apertures are formed at least in the stator discs for the passage of a heat-exchange medium, said apertures extending over a peripheral angle which is greater than the second angle of displacement.

9. An eccentric disc pump according to claim 8 wherein the ends of the passage openings are fitted with sealing rings.

10. An eccentric disc pump according to claim 1 wherein for each coupling position at least three coupling means are offset relatively to each other through a partial unit angle which is determined by the smallest second angle of offset concerned.

11. An eccentric disc pump according to claim 10 wherein coupling means relatively offset by the partial unit angle are distributed over the entire circumference of the stator discs.

12. An eccentric disc pump according to claim 11 wherein the stator discs have a ring of axial apertures which receive at least one coupling rod extending over the entire length of the stator.

13. An accentric disc pump according to claim 11 wherein on one side of each stator disc a ring of recesses is formed and on the other side a ring of coupling projections for engaging in similar recesses in another stator disc.

14. An eccentric disc pump having a plurality of individual axially interconnected pump stages of predetermined width, a stator disc in each pump stage enclosing a central cavity, a shaft carried in said central cavities, a rotor disc mounted in each pump stage for rotation eccentrically in said central cavity, successive rotor discs being angularly offset relative to the rotor disc of a preceding pump stage and adjacent stator and rotor discs being angularly offset relatively to each other at angles of displacement, coupling means respectively engaging each stator disc with that of an adjacent pump stage and positively locating such adjacent stator disc in positions offset by a second angle one half of the first mentioned angular displacement between corresponding adjacent rotor discs whereby in each pump stage the cavity of the stator disc forms an enveloping curve for the path of the rotor disc rotatable therein, at least two recesses open on one side in the direction of the pump axis being provided in each stator disc near its periphery, said coupling means including respective coupling members engaging in said recesses coupling recesses of each stator disc being offset relatively to each other by said second angle, each of said coupling members extending at least over two pump stages and engaging radially from the outside into said recesses.

15. An eccentric disc pump according to claim 14 wherein apertures are formed at least in the stator discs for the passage of a heat-exchange medium, said apertures extending over a peripheral angle which is greater than the second angle of displacement.

16. An eccentric disc pump according to claim 14 wherein the ends of the passage openings are fitted with sealing rings.

17. An eccentric disc pump according to claim 14 wherein at least the cavity of the stator disc is lined with stable shape-retaining moldable material.

18. An eccentric disc pump according to claim 14 wherein at least one packing ring is inserted between adjacent stator discs.

19. An eccentric disc pump according to claim 18 wherein the packing ring has an O-ring located in an annular groove of each stator disc.

20. An eccentric disc pump according to claim 14 wherein two stator or rotor discs of adjacent pump stages are formed together in one piece as a double disc.

21. An eccentric disc pump according to claim 20 wherein two cavities inclined one towards the other through the second partial angle are formed in a stator disc from both ends.

* * * * *